United States Patent [19]

Shelton

[11] 3,951,595

[45] Apr. 20, 1976

[54] VAPOR PHASE PROCESS FOR CELLULOSE FABRICS

[75] Inventor: Thomas S. Shelton, Mt. Carmel, Ohio

[73] Assignee: McGraw-Edison Company, Elgin, Ill.

[22] Filed: July 10, 1974

[21] Appl. No.: 487,731

[52] U.S. Cl. ..... 8/116.4

[51] Int. Cl.[2] ..... D06M 13/14

[58] Field of Search ..... 8/116.4

[56] References Cited

UNITED STATES PATENTS

| | | | |
|---|---|---|---|
| 3,653,805 | 4/1972 | Gamarra et al. | 8/116.4 |
| 3,660,013 | 5/1972 | Payet et al. | 8/116.4 |
| 3,663,974 | 5/1972 | Watanabe et al. | 8/116.4 |
| 3,841,832 | 10/1974 | Swidler et al. | 8/116.4 |

*Primary Examiner*—Carman J. Seccuro

*Attorney, Agent, or Firm*—Charles F. Lind

[57] ABSTRACT

A vapor phase treatment utilizing formaldehyde and sulfur dioxide gas engulfment in a chamber of a moistened fabric, improved by specifically delaying discharge of the catalytic sulfur dioxide gas into the chamber until after approximately 40–60% concentration of formaldehyde gas has been achieved in the chamber.

4 Claims, No Drawings

VAPOR PHASE PROCESS FOR CELLULOSE FABRICS

Fabric of cotton or other cellulose containing materials, more commonly blended with a synthetic of polyester or the like, can be treated with a gaseous mixture of formaldehyde and steam, where sulfur dioxide is used as a catalyst, to cross link the cellulose fibers for improving certain characteristics of the fiber. This "vapor phase" process is disclosed in U.S. Pat. No. 3,706,526 issued Dec. 19, 1972 to Swidler et al, and apparatus suitable for performing this process is disclosed in U.S. Pat. No. 3,660,013 issued May 2, 1972 to Payet, et al and in U.S. Pat. No. 3,738,019 issued June 12, 1973 to Forg, et al; and these teachings are incorporated by reference in this application.

The basic "vapor phase" treatment with formaldehyde and steam, and the sulfur dioxide catalyst, can be successfully used on cotton or cotton blended fabrics to achieve varying end goals of size retention, crease retention, color retention or the like. For example, 100% cotton knit shirts, when subjected to a relatively light treatment of this process, have greatly improved size stability as compared to the same untreated shirts when both are subjected to subsequent washings. Conventional 65% cotton, 35% polyester blended work shirts and work pants can be subjected to a heavier treatment of this process to give improved crease retention to the garmens. Lab coats, nurses uniforms or like garments fabricated of a blended cotton can also be subjected to a treatment of this process for improved color and crease retention, and size stabilization.

Basically, the cotton in the fabric can be subjected only to a limited or controlled process to avoid excessive deterioration or degragation thereof, while the process does not effect blend in the fabric in this manner; to the end that extreme care is required to practice the process commercially.

The basic "vapor phase" process requires an enclosure within which the fabric is located and the component chemicals are introduced. One parameter to the process is that the fabric be moistened without being wetted to a water weight percentage of approximately 5–20% of the weight of the cellulose fibers, with the optimum range being approximately 7–12%; and this is achieved by generating in the enclosure a high humidity atmosphere of air and steam maintained at low temperature by flowing cooling water over the inside enclosure walls. A second parameter is that the formaldehyde must be added to the fabric to the extent of approximately 0.3% to 0.6% weight of the cellulose fiber content in the fabric; and this is achieved typically in the sealed enclosure by burning off para-formaldehyde powder deposited on hot plate generator means to form formaldehyde gas which fills the enclosure and thus engulfs the fabric. A third parameter is introducing a catalyst, typically in the form of sulfur dioxide gas, to approximately 1–3% volume at atmospheric pressure and temperature to cause the formaldehyde vapors to react with the cellulose fibers to cross link them. A fourth parameter is the time of exposure of the fabric to the formaldehyde atmosphere.

This invention teaches an improvement in this basic vapor phase treatment which gives more accurate process control to allow greater consistency in the treated fabric, and to allow the commercial practice of the process.

This invention provides for the delayed addition of the catalytic sulfur dioxide gas to within the enclosure until approximately 40–60% of the para-formaldehyde powder has been burned off the hot plate generator means.

In practice because of the variations in temperature and humidity conditions of the atmosphere, the parameter which appears most difficult, and in a sense, most critical to maintain is the moisture level present in the garment. For example, on a high humidity summer day, there may be as much as 4% or 5% moisture in the garment before any additional moisture is added incident to this process; whereas in dry winter conditions this moisture content may be only approximately 1%. Because of this wide variance, commercial machines are now available which more closely control the amount of moisture added to bring this one parameter into a rather high degree of control. On the other hand, depending on the type and weight of the fabric, and the purpose to which the treatment is applied to the fabric, the actual amounts of formaldehyde and sulfur dioxide gas present in the chamber appears not to be as critical, . . . provided a minimum concentration has been reached, than control of moisture content of the fabric. In practice therefore, it is common to set and constantly maintain the same discharges of formaldehyde and/or sulfur dioxide in successive runs of fabric or batches of like garments.

It is generally noted that a preferred manner of discharging sulfur dioxide gas into the chamger is to dump the gas from a given size tank charged to a given pressure, for example 5 psi, until the pressures in the chamber and the tank become equalized. The tank in turn can be charged or recharged from a industrial sized tank typically supplied at a higher pressure of the order 35–50 psi. The exact volume of sulfur dioxide required for successive batches thus is readily maintained, and/or can be readily changed by varying the size of the tank and/or the initial pressure confinement of the gas in the tank.

The first example of the improved process is as practiced in a single batch chamber similar to the equipment disclosed in U.S. Pat. No. 3,738,019, where the chamber is approximately 1,000 cu. ft. and holds 180 work shirts or pants of 65/35% cotton blend in suitably spaced relationship to one another, and the purpose of the treatment is for improved crease retention. A charge of approximately 6 pounds of para-formaldehyde is needed operating off four hot plate generators.

According to this invention, after the paraformaldehyde has been deposited onto the generators there is a delay of approximately 1 to 2 minutes and preferably 90 seconds before any sulfur dioxide gas is discharged into the chamber, which can be totally accomplished in approximately 15 to 30 seconds. For this reaction, approximately 20 cubic feet of sulfur dioxide are required, for an approximate 2% volume concentration. Typically, steam is discharged in the chamber all the while the formaldehyde is being vaporized for good mixing in the chamber; whereas after initially discharging the sulfur dioxide the steam discharge is terminated for approximately 5 seconds to 15 seconds and preferably only for about 5 seconds and thereafter the steam discharge continues to the shut off of the sulfur dioxide gas dicharge. This interrupted steam discharge mixes the gas components and increases penetration into the garments without adding excessive moisture to the garments. The 1 to 2 minutes and preferably 90 seconds delay before the admission of the sulfur dioxide gas is sufficient, with the charge of para-formaldehyde solids that must be turned off, to generate in the enclosure approximately 40–60% of the formaldehyde gas concentration.

By way of further example, utilizing a continuous-batch process as disclosed in U.S. Patent application entitled "Vapor Phase Reactor and Method" having Ser. No. 438,587, filed Feb. 1, 1974 in the name of Thompson et al, a series of separated chambers are used where only a single process is performed in any one chamber and the garments are transferred successively from the first chamber on through all the other chambers until the process is completed. In the specific commercial equipment used, there is a first chamber where the garments are moistened to the proper consistency, there is a second chamber where the chemicals including specifically the formaldehyde and the sulfur dioxide gases are applied to the garments, there is a third chamber where the garments are heated to a high temperature whereat the formaldehyde is set or cross linked with the garments, and there is a last chamber where the garments are moistened as well as heated in an effort to drive off any remaining odors or non-linked formaldehyde gas. In such a batch-continuous system the chemical reaction chamber is approximately 150 cu. ft. and twenty (20) all cotton knit golf shirts are simultaneously treated with the purpose only of stabilizing size or shrink control. In this situation, approximately ½ lb. of para-formaldehyde charge has to be vaporized by means of two hot plate generators, and the delay of sulfur dioxide required is approximately 10 to 20 seconds and preferably 15 seconds where thereafter the sulfur dioxide is dicharged without steam for a short period of approximately 5 to 15 seconds and preferably 10 seconds and thereafter with steam for an additional 10 to 30 seconds and preferably 15 seconds. Approximately 1½ cubic feet of sulfur dioxide are required for this reaction, utilizing a volumetric concentration of generally 1%. The shorter delay preferred appears in part to be because the end purpose of the treatment is different and a lesser concentration of formaldehyde is needed and used and this allows the formaldehyde to burn off at a quicker rate, and because of the smaller overall chamber volume.

It will thus be apparent that various other chamber configurations might require different delays from those given by way of example herein, and likewise the manner or the rate of charging the para-formaldehyde into the cabinet may determine a different delay before applying sulfur dioxide gas. However, it appears preferable to delay applying any sulfur dioxide gas until approximately 40–60% of the required total gaseous formaldehyde concentration is achieved in the chamber, and this can typically be determined for example by means of burning off approximately such percentage of the total mass of para-formaldehyde that must be burned off during the process, and thereafter to discharge the sulfur dioxide.

What is claimed is:

1. In a method of vapor treating in an enclosure a cellulose or cellulose blend fabric, where the fabric is initially moistened to a concentration of water weight of 5–20% weight of the cellulose fibers in the fabric and thereafter is subjected to gaseous formaldehyde to add same to approximately 0.3% to 0.6% weight of the cellulose fibers, the improvement being the delaying of the application of the catalyst in the form of a charge of sulfur dioxide gas metered into the enclosure until an approximate gaseous build up has been achieved in the enclosure of 40–60% of the total formaldehyde charge required, and thereafter to discharge steam into the enclosure a short duration in the order of seconds for mixing the sulfur dioxide and the formaldehyde gases.

2. In the vapor treating method according to claim 1, further wherein the charge of sulfur dioxide gas is initially metered into the enclosure without steam discharge for a short duration in the order of seconds and is then discharged simultaneously with steam until all the required sulfur dioxide gas has been dicharged.

3. In the vapor treating method according to claim 1, further comprising delaying the addition of sulfur dioxide gas for a minimum period of 10 to 15 seconds after the initial build up in the cabinet of the formaldehyde gas.

4. In the vapor treating method according to claim 1, further comprising delaying the addition of sulfur dioxide gas for minimum period of 10 to 15 seconds after the initial release of para-formaldehyde powders onto a hot plate generator.

* * * * *